73-666 SR
OR 3,945,246

United Stat
Wadensten

[11] 3,945,246
[45] Mar. 23, 1976

[54] VIBRATING TABLE WITH DUAL PLATE TOP

[76] Inventor: Theodore S. Wadensten, P.O. Box 8, Stilson Road, Wyoming, R.I. 02898

[22] Filed: Oct. 24, 1974

[21] Appl. No.: 517,597

[52] U.S. Cl. ..... 73/71.6
[51] Int. Cl.[2] ..... B06B 1/00
[58] Field of Search.. 73/71.6; 198/220 CB, 220 CA

[56] References Cited

UNITED STATES PATENTS

| | | | |
|---|---|---|---|
| 2,706,400 | 4/1955 | Unholtz | 73/71.6 |
| 3,699,807 | 10/1972 | Kerley, Jr. et al. | 73/71.6 |

*Primary Examiner*—Richard E. Aegerter
*Assistant Examiner*—Willis Little
*Attorney, Agent, or Firm*—Ralph R. Roberts

[57] ABSTRACT

This invention relates to a vibrating table where a rotary motion vibrator is used to provide vertical oscillations. In this table top arrangement the vibrator is secured to a frame or lower plate member preferably at or about its midpoint. This lower frame member is conventionally supported by a support base through vibration isolators such as coil springs provided at its corners. To at least two edges of this lower frame member are secured transfer pads which also are secured to the like edges of and carry the upper table top a spaced distance above the lower frame. The resulting vertical motion and frequency are equal or substantially equal at all portions of the table top and there is an absence of "dead spots." Conventional table tops of vibrating tables to which the vibrator is directly secured have a dead spot or spots and the amplitude is unequal causing the material or product thereon to walk or move to one side. Where the "dead spots" occur on conventional tables the material is neither moved or vibrated.

9 Claims, 11 Drawing Figures

VIBRATING TABLE WITH DUAL PLATE TOP

BACKGROUND OF THE INVENTION

1. Field of the Invention

With reference to the classification of art as established by the United States Patent Office the present invention is found in the general Class of "Measuring and Testing" (Class 73) and more particularly in the subclass entitled, "vibration" (subclass 67) and even more particularly in the subclass thereunder entitled, "table or platform" (subclass 71.6).

2. Description of the Prior Art

Vibration tables and the requirement for their particular attributes are well known. In test equipment and in packaging it is very desirable that the desired amplitude and frequency are alike at all points of the table top. Many horizontal vibration testing tables are shown in U.S. Patents among which is U.S. Pat. No. 3,164,984 to GERTEL as issued on Jan. 12th, 1965. Slip tables are shown in U.S. Pat. No. 3,208,270 to HILL as issued on Sept. 28th, 1965. A vibration table employing a plurality of toggle lifts is shown in U.S. Pat. No. 3,044,292 to MATTHEWS as issued on July 17th, 1962. Other vibration table systems of note are shown in U.S. Pat. No. 3,534,588 to SCHULZ on Oct. 20th, 1970 and in U.S. Pat. No. 3,534,589 to GIBBONS also on Oct. 20th, 1970. Typical of many single top vibrating table structures is U.S. Pat. No. 3,262,308 to SCHLOSS as issued on July 26th, 1966. As far as can be ascertained, these and other tables commercially available do not provide a vibrating table top whose frequency and vertical amplitude are equal at all points of the table.

In the apparatus of this invention a single rotary vibration unit is employed to vibrate a bottom plate or frame. The vibration forces are transmitted from this bottom plate to a top plate through edge transfer pads. The resulting table vibrations provide substantially equal amplitude and frequency at all portions of this top plate and an absence of "dead spots".

SUMMARY OF THE INVENTION

This invention may be summarized at least in part with reference to its objects.

It is an object of this invention to provide, and it does provide, a vibrating table top whose amplitude and frequency are substantially alike at all horizontal areas thereof.

It is a further object of this invention to provide, and it does provide, a vibrating table top carried by and secured to two or more edge support pads attached to a lower frame. This frame carries and is vibrated by a rotary vibrating means.

The vibrating table of this invention provides a top plate which is indirectly supported in a horizontal position by a base or frame. Vibration isolation of the table from the base is by springs, rubber shock absorbers or inflatable air mounts. These vibration isolators support a bottom plate or frame. One or more rotary vibrators, either electric, pneumatic or hydraulic are secured to the underside of the bottom plate at or near its middle depending on table length. The amplitude and frequency of the vibrator are either adjustable or fixed to accommodate the desired operating conditions. On at least two of the edges of the bottom plate there is secured at each edge a transfer pad which also is attached to like edge portions of the top plate to hold this plate in a fixed spacing and position to the bottom plate.

In addition to the above summary the following disclosure is detailed to aid in understanding of the invention. This disclosure, however, is not intended to cover each new inventive concept therein no matter how it may later be disguised by variations in form or additions of further improvements. For this reason there has been chosen a specific embodiment of the vibrating table top as adopted for use with a rotary vibrator and showing a preferred means for retaining the top plate by only its edges to a bottom plate or frame. This specific embodiment and alternate embodiments thereof have been chosen for the purposes of illustration and description as shown in the accompanying drawings wherein:

BRIEF DESCRIPTION OF THE DRAWINGS

In the following description and in the claims various details are identified by specific names for convenience; these names, however, are intended to be generic in their application. Corresponding reference characters refer to like members throughout the several figures of the drawings.

The drawings accompanying, and forming part of, this specification disclose certain details of construction for the purpose of explanation but it should be understood that these structural details may be modified in various respects and that the invention may be incorporated in other structural forms than shown.

DESCRIPTION OF THE PREFERRED EMBODIMENT OF FIGS. 1 AND 2

Figure 2:
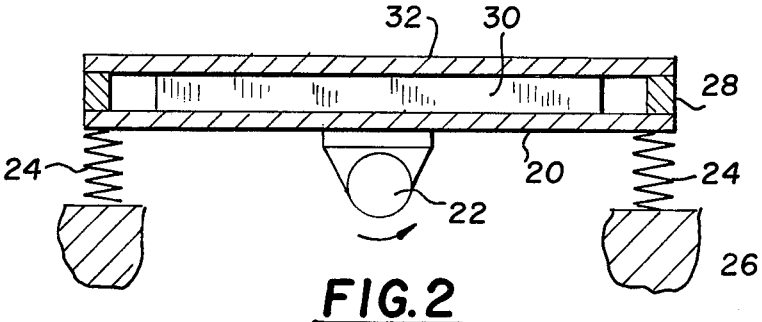
FIG. 2 represents a somewhat diagrammatic sectional view taken on the line 2—2 of FIG. 1 and looking in the direction of the arrows.
Figure 1:
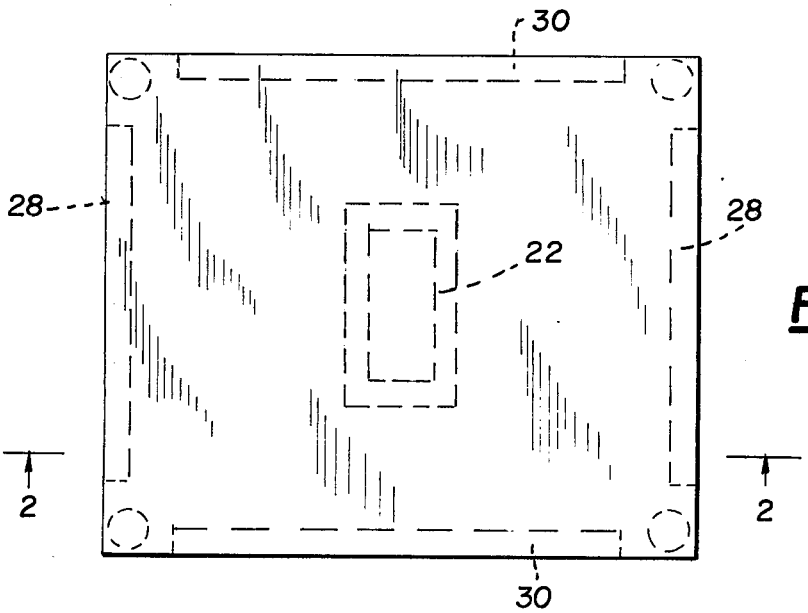
FIG. 1 represents a somewhat diagrammatic plan view of a conventionally-shaped vibrating table of this invention and particularly indicating the preferred connection of the top plate to the bottom drive plate through edge transfer support members.

Referring now to the drawings and in particular to FIGS. 1 and 2, there is depicted a preferred arrangement of the double table top vibrating table of this invention. A lower plate 20 has mounted midway and on its underside a rotating vibrator 22. This vibrator may be powered by air, hydraulic or an electrical motor. This lower plate 20 is supported at its four corners by like compression springs 24 which on their lower ends rest upon and are secured to a support member 26 which is customarily a base frame particularly made to support the vibrating double table top. These springs support and are attached to the lower plate. The upper surface of the lower plate member 20 carries and has attached to its four edges spacer bars which are identified as end spacer bars 28 and side spacer bars 30. An upper table top member or plate 32 is attached to the end and side spacer bars 28 and 30 at only its edges so that there is a determined space between the upper and lower plate members 20 and 32. In its assembled condition the vibrations induced into the lower plate 20 are transmitted to the upper plate 32 at only its edges. Attachment at the edges may be by welding bolts, etc.

ALTERNATE LOWER BASE FRAME OF FIG. 3

Figure 3:
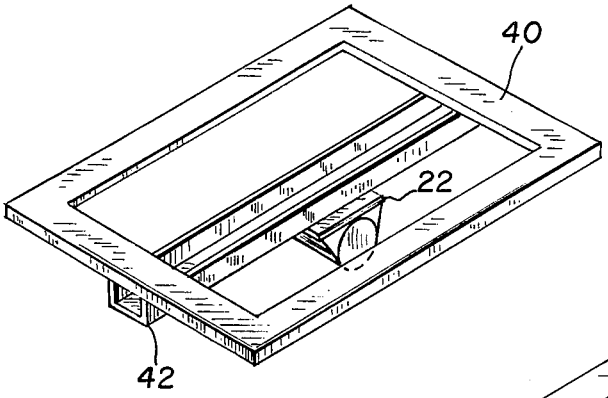
FIG. 3 represents an isometric diagrammatic view of an alternate bottom plate configuration in which a frame assembly instead of a solid plate is used to carry the rotating vibrator.

Referring next to FIG. 3, it is to be noted that instead of a solid base plate 20, as in FIG. 1, a peripheral frame 40 of less weight may be provided. Attached to the end extensions is a channel 42 and to the midlength of this channel is secured the vibrator 22. The springs 24 and spacer members 28 and 30 are attached to the edges of this frame 40, as shown in the embodiment of FIGS. 1 and 2. To spacer bar members 28 and 30 the upper plate 32 is secured to provide a double plate top, as in FIGS. 1 and 2. It is also to be noted that channel 42, if desired, may be attached to the longitudinal sides or at right angles to the present arrangement.

ALTERNATE LOWER BASE FRAME AS SEEN IN FIG. 4

Figure 4:
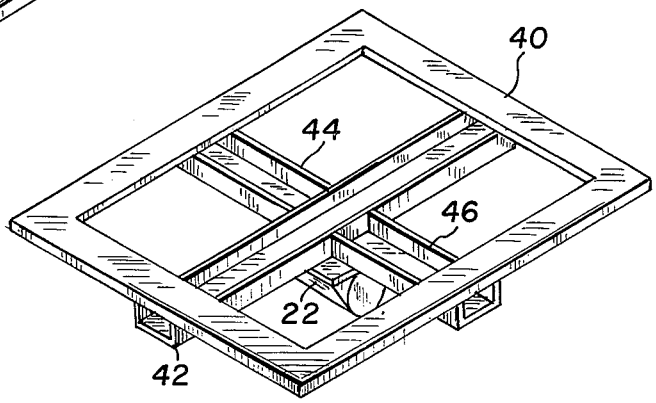
FIG. 4 represents an isometric diagrammatic view of an alternate bottom frame construction to carry the vibrating roller and transfer support members, this frame being similar to that shown in FIG. 3 but having an additional transverse side member.

Referring next to FIG. 4, it is to be noted that the frame 40 of FIG. 3 and the channel 42 attached thereto may also have transverse support members 44 and 46 to extend to the longitudinal side portions of the frame 40 to provide additional support particularly for larger table top sizes. To the midlength of the channel 42, as in the case of FIG. 3, is attached the vibrator 22. Springs 24 and side and end spacer bars 28 and 30 are attached to this frame 40 as in the manner of FIGS. 1 and 2.

LOWER PLATE ASSEMBLY OF FIG. 5

Figure 5:
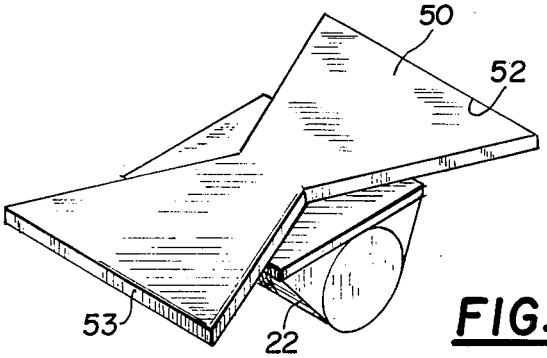
FIG. 5 represents an isometric diagrammatic view of yet another alternate bottom plate configuration for assemblies in which only the short ends of the upper plate are attached to transfer support members.

Referring next to FIG. 5, it is to be noted that instead of the rectangular lower plate 20 of FIG. 1 the plate may be contoured to provide a lower plate 50. Such a contour may be used with smaller size vibrating tables. Only the end portions 52 and 53 which are parallel to each other are utilized as the support surfaces for spacer bars 28 and to these end bars is attached the upper plate 32. Springs 24 are attached to the outer corners as in the manner of FIGS. 1 and 2. The upper plate 32 of FIGS. 1 and 2 is secured to the plate 50 only through the end spacer bars 28.

ALTERNATE LOWER PLATE ASSEMBLY OF FIG. 6

Figure 6:
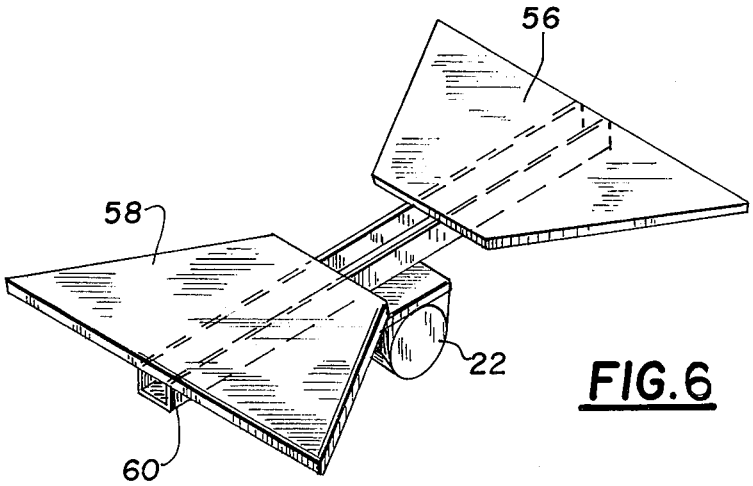
FIG. 6 represents an isometric diagrammatic view of a bottom plate assembly as an alternate to the construction of the bottom support plate of FIG. 5.

Referring next to FIG. 6, there is depicted a lower plate assembly as an alternate of the single contoured plate 50, shown in FIG. 5. Trapezoidally-shaped plates 56 and 58, which are depicted as mirror images of each other, are attached to a channel 60 to whose midlength is attached the vibrator 22. As in the manner of FIG. 5, end spacer bars 28 are secured to the end edges of the plates 56 and 58. Attached to the spacer bars 28 and secured to the plates 56 and 58 is upper plate 32 which is fixed to the plates 56 and 58 only at its end. The double plate vibrating table is then supported by springs 24 secured to the four resulting corners of the assembly of FIG. 6.

DESCRIPTION OF THE PRIOR ART AS SEEN IN FIGS. 9, 10 AND 11

Figure 9:
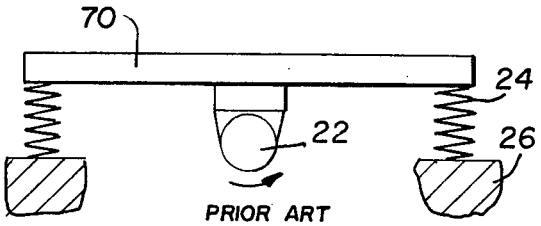
PRIOR ART FIG. 9
FIG. 9 represents a diagrammatic side view of a typical single table top vibrating table.
Figure 10:
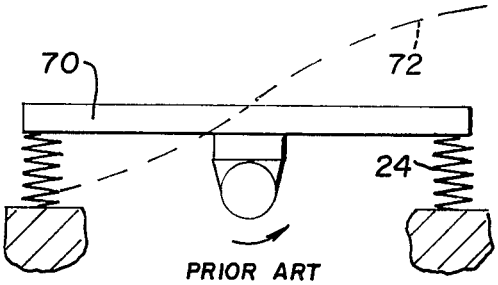
PRIOR ART FIG. 10
FIG. 10 is a diagrammatic representation of the single table top of FIG. 9 and showing the vibration amplitude and characteristics of the single table top.
Figure 11:
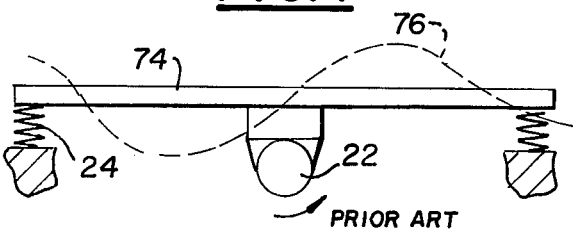
PRIOR ART FIG. 11
FIG. 11 represents a diagrammatic side view of a single table top vibrating table similar to that of FIG. 9 but showing a long table and the vibration amplitude and characteristics.

FIGS. 9, 10 and 11 diagrammatically represent vibrating table tops where the vibrator is secured to a single table top. As seen in FIG. 9, a single table top 70 carries a vibrator 22 on its underside and on support member 26 springs 24 isolate the single table top. Where the table top is a short table top in relation to the amplitude provided by the vibrator, the resulting amplitude vibration is depicted by the dashed line 72. As reduced to practice, the vibrations are greater at the edges than at the center. Where a short table is provided a dead spot usually occurs at the point of attachment of the vibrator 22 to the single table top 70.

Referring next to FIG. 11, there is depicted the amplitude and vibration cycle of a long table top 74 driven by the vibrators 22 and supported by springs 24. This depicted cycle is represented as dashed line 76. There are three dead spots on the table top where the amplitude line passes through the table top.

OPERATION OF THE DOUBLE TABLE TOP AS SEEN IN FIGS. 7 AND 8

Figure 8:
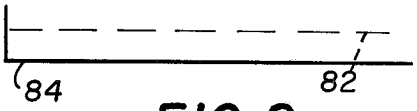
FIG. 8 represents an approximate diagrammatic representation of the intensity of the amplitude and the vibration characteristics of the upper table top of FIG. 7.
Figure 7:
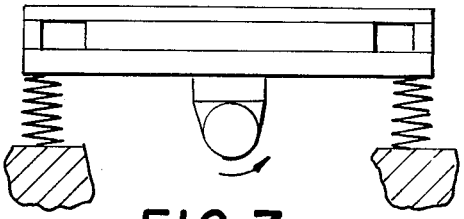
FIG. 7 represents a sectional view similar to that of FIG. 2 and in combination with FIG. 8 shows the operating characteristics of the double vibrating plate table.

Referring next and finally to FIGS. 7 and 8, there is contrasted the resulting amplitude and vibration frequency lines of the double top of this invention to the single table top of FIGS. 9, 10 and 11 of the prior art. The double plate table top of this invention produces an even vibration whose amplitude is the area between the dashed line 82 and the lower solid line 84. This has been established by exhaustive tests with the entire upper plate vibrating at substantially the same amplitude. The horizontal motion is minimal and equal and there is no tilting action. This is contrary to the single table top where solid objects or powdered material placed upon it tends to drift to one side and the vibration is not equal over the entire top. Conventionally, vibrating tables using rotary vibration inducers are for testing and/or the packing of materials as well as determining the security of components such as are found in electrical apparatus and the like. Where the single table top gives a larger amplitude on one side of the table than on the other, the material placed on the table will have a tendency to move to one side of either the container or to one side of the table. The double plate vibrating table top of this invention permits packing into a container additional material to a selected level height. In the double table top the bottom plate vibrates in the same manner as in FIGS. 9, 10 and 11, however, the transmitting of all of the vibrations only through the transfer pads at the edges of the plate results in the vibrations evening themselves out and the amplitude at one pad is exactly transmitted to those on the other side. Wave deflectors provided in some single plate table tops are eliminated and only the vertical vibrations through the spacer bars are transmitted to the top plate. It is only by eliminating the horizontal vectors produced by a single table top that the tendency for a table top to tilt during vibration is eliminated and the dead spot or spots created by the vibrator and the resulting sine waves are eliminated.

It is to be further noted that it is merely a matter of selection as to whether mechanical springs, rubber mounts or inflatable air mount vibration isolators are used with the double table top. If required, the upper plate may be made as a grid or with special patterns. As long as the upper plate is spaced from the lower plate and the forces transferred by the rotary vibration are only at the edges of the plates, the vibration pattern at the upper plate is as in FIG. 8.

The shape and extent of the top plate is merely a matter of selection. One, two or more vibrating units may be provided. As long as the bottom plate or frame is the prime vibrated member, the transfer of the vibrations to the top plate or member is only by transfer pads at the outer perimeters thereof. This means of transferring the vibration forces insures that the vertical oscillations of this top plate are substantially equal over the entire top surface.

Terms such as "left," "right," "up," "down," "bottom," "top," "front," "back," "in," "out" and the like are applicable to the embodiments shown and described in conjunction with the drawings. These terms are merely for the purposes of description and do not necessarily apply to the position in which the vibrating table top may be constructed or used.

While a particular embodiment and alternates thereof have been shown and described it is to be understood that modifications may be made within the scope of the accompanying claims and protection is sought to the broadest extent the prior art allows.

What is claimed is:

1. A vibrating table having a dual top and whose top surface is absent dead spots as it is vertically oscillated by at least one rotary motion vibrator, and as thus vibrated the entire top surface vibrates with substantially the same amount of vertical oscillation, said table as constructed including: (a) a support base; (b) a multiplicity of vibration isolators, each secured at one end to and carried by the support base; (c) a lower frame carried by the vibration isolators so as to be at least partially independently movable with respect to the support base; (d) rigid transfer pads carried by and secured to at least two edge portions of the lower frame and spaced from each other to define and provide a support plane a fixed short distance above the lower frame; (e) an upper table top member secured to and carried by the rigid transfer pads and at only said edge portions so that said upper top member is spaced a determined distance above the lower frame, all areas of the entire upper table top member being moved vertically in accordance with the amplitude and frequency of vibrations of the lower frame which are present at those edge areas of fixed attachment of the transfer pads to the lower frame, and (f) at least one rotary motion vibrator secured to the lower frame and when actuated adapted to impart vertical oscillations at a selected frequency and amplitude to the lower frame to which it is attached.

2. A vibrating table as in claim 1 in which the lower frame has two substantially parallel ends and a transfer pad is mounted to and at each of these ends and to and at each of the ends of the upper table top member.

3. A vibrating table as in claim 2 in which the lower frame also has two substantially parallel sides and a transfer pad is mounted to and at each of these ends and to and at each of the sides of the upper table top member.

4. A vibrating table as in claim 1 in which the lower frame and top plate are substantially like-sized rectangular plates.

5. A vibrating table as in claim 1 in which the lower frame is a peripheral frame attached to a mid-supporting member.

6. A vibrating table as in claim 5 in which the rotary motion vibrator is attached to the mid-supporting member.

7. A vibrating table as in claim 1 in which the lower frame is a plate-like configuration with the longitudinal sides inwardly contoured from a straight line with the ends of said frame arranged in a parallel manner, the transfer pad means carried at the end portions.

8. A vibrating table as in claim 1 in which the vibration isolators are compression springs arranged at the four corners of the upper table top member.

9. A vibrating table as in claim 1 in which the lower frame is a welded assembly including trapezoidally-shaped plate forms.

* * * * *